United States Patent [19]

Vacilotto

[11] 4,219,931

[45] Sep. 2, 1980

[54] VACUUM HAIR TRIMMER

[76] Inventor: Silvano Vacilotto, 7955 Kipling Ave. North, Woodbridge, Ontario, Canada, L4L 1B3

[21] Appl. No.: 633

[22] Filed: Jan. 2, 1979

[30] Foreign Application Priority Data

Jan. 4, 1978 [CA] Canada ..... 294301

[51] Int. Cl.[2] ..... B26B 19/44

[52] U.S. Cl. ..... 30/133; 30/41.5

[58] Field of Search ..... 30/133, 41.5, 41.6

[56] References Cited

U.S. PATENT DOCUMENTS

| | | | |
|---|---|---|---|
| 2,518,181 | 8/1950 | Renne | 30/41.5 X |
| 2,598,212 | 5/1952 | Blair | 30/133 |
| 2,916,821 | 12/1959 | Witmer | 30/133 X |
| 3,654,699 | 4/1972 | Garcia | 30/133 |

*Primary Examiner*—Jimmy C. Peters

*Attorney, Agent, or Firm*—Holman & Stern

[57] ABSTRACT

A self-contained vacuum hair trimmer containing an electric motor for driving a fan within a handle, as well as hair trimmer means at one end of such handle. A bag is attached to the other end of such handle to collect the so-trimmed hair which is driven into the bag by such fan on account of the vacuum created in the handle behind the trimmer. An adjustable nozzle is mounted on the handle for gauging the length of the hair being trimmed.

4 Claims, 2 Drawing Figures

VACUUM HAIR TRIMMER

This invention relates to vacuum hair trimmers.

Vacuum hair trimmers that use an external source of vacuum have been proposed. Also, trimmers that employ a combination of motor driven clippers and an external vacuum source for collecting hair cuttings are known. In either case the external vacuum hoses are a great inconvenience, inasmuch as they interfere with the trimming operation.

The main object of this invention is to provide a vacuum hair trimmer that is truly portable and self-contained for manual use.

According to the invention a portable, hand, vacuum hair trimmer is provided comprising a self-contained vacuum source as well as a bag for collecting the hair trimmings, removably connected to one end of a handle which constitutes a housing for a vacuum fan motor which also powers trimmer means at the other end of the handle. A hair length gauge in the form of an adjustable nozzle is mounted over the trimmer, so that as hair to be trimmed is drawn into the nozzle on hair that is longer than that of the gauge is trimmed. The bag for collecting the trimmings is contained in a plastic casing having windows for the escape of air from the bag.

In the drawings, which illustrate embodiments of the invention,

Figure 1:
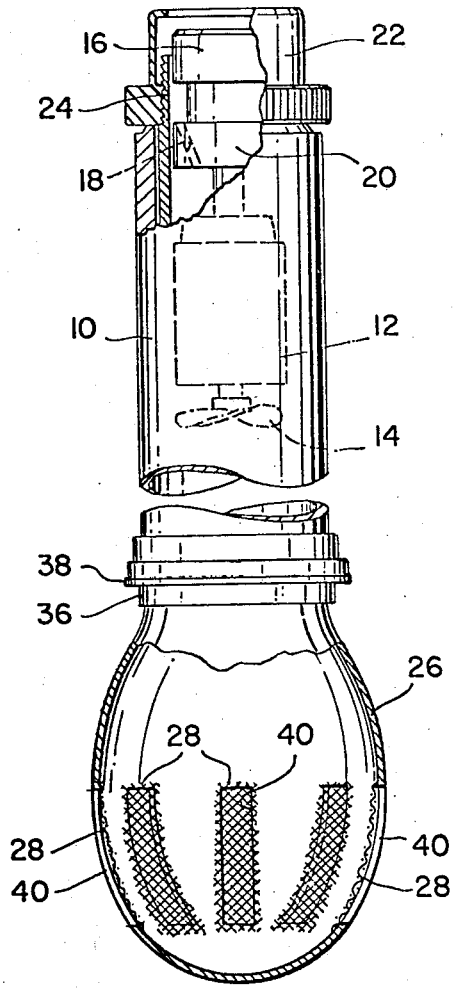
FIG. 1 is a fragmentary view partly in section of one embodiment.
Figure 2:
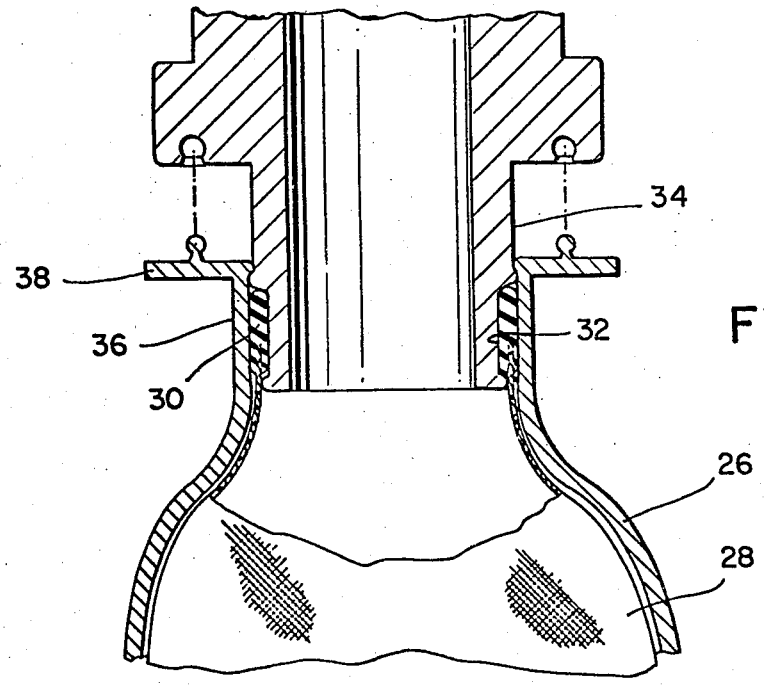
FIG. 2 is an enlarged fragmentary view mainly in section of a detail of the connection between the end of the handle and the bag-casing.

The vacuum hair trimmer illustrated comprises a hollow handle 10 in which a motor 12 is mounted. A fan 14 is carried on one end of the motor drive shaft which, at its other end, carries a hair trimmer 16 comprising rotary hair clippers. The trimmer 16 is arranged near the entrance to the handle 10. The fan 14 draws air through the trimmer 16 and into the handle 10 via air passages 18 in a motor mount 20 arranged between the hair trimmer 16 and the motor 12. An adjustable hair nozzle 22 is threaded onto a sleeve 24 projecting from the handle 10. The nozzle covers the hair trimmer 16 and by adjusting its position relative to the sleeve the length of hair trimmed by the trimmer 16 may be gauged.

A bulbous plastic casing 26 containing a porous bag 28 is removably mounted on the rear end of the handle 10. For this purpose the mouth of the bag 28 comprises a resilient cylinder 30 that is squeezed into an annular recess 32 in a tubular extension 34 of handle 10, by an annular sleeve 36 on such extension. To remove the bag

28, the flange 38 of sleeve 36 is slid downwardly to uncover the bag mouth 30. The casing 26 is provided with windows 40 for venting air from bag 28, leaving the hair trimming in such bag.

In operation, the nozzle 22 is adjusted to the desired position. The motor 12 is then switched on to drive the fan 14 and the hair trimmer 16. The nozzle 12 is passed over the hair to be trimmed which is drawn into the hair trimmer 16 by means of the current of air created by the fan 14. The trimmed lengths of hair pass through the handle 10 and into the bag 28 where they are collected. Periodically, the bag 26 may be removed in the manner described to empty out its contents.

The embodiments of the invention in which an exclusive property or privilege is claimed are defined as follows:

1. A portable, self-contained vacuum hair trimmer comprising a tubular portion providing a hollow handle adapted to be held by an operator, a motor mounted in said tubular portion, a hair cutting means at one end of said tubular portion adapted to be driven by said motor, a fan in said tubular portion also adapted to be driven by said motor and generate a vacuum in said tubular portion adjacent said hair cutting means so as to draw hair cuttings through said handle, a nozzle mounted at said one end over said hair cutting means, and said nozzle being in the form of a cap having sidewalls and an open end, said open end being adapted to contact the head of a person whose hair is to be cut, said nozzle providing a closed air path from said open end thereof to said tubular portion to ensure a maximum vacuum at said open end, said cap further being axially displaceable relative to said cutting means to gauge the length of hair left after cutting, a porous bag having a mouth detachably connected to the other end of said tubular portion to collect hair trimmings drawn therethrough, the mouth of said bag comprising a resilient cylinder which is squeezed into an annular recess at said other end of said tubular portion, and a bulbous plastic casing containing said bag, having windows for the exit of air from the bag.

2. A portable, self-contained vacuum hair trimmer as defined by claim 1, in which said cap is screw-threadably mounted.

3. A portable, self-contained vacuum hair-trimmer as defined by claim 5, in which said cap is mounted on a sleeve projecting from within said tubular portion.

4. A portable, self-contained vacuum hair-trimmer as defined by claim 1, wherein said resilient cylinder is squeezed into said annular recess by a sleeve portion of said casing.

* * * * *